US007419131B2

(12) United States Patent
Von Limburg

(10) Patent No.: US 7,419,131 B2
(45) Date of Patent: Sep. 2, 2008

(54) HOLDING DEVICE

(75) Inventor: Felix Von Limburg, Magdeburg (DE)

(73) Assignee: B.T. Innovation GmbH, Magdeburg (DE)

( * ) Notice: Subject to any disclaimer, the term of this patent is extended or adjusted under 35 U.S.C. 154(b) by 66 days.

(21) Appl. No.: 10/563,535

(22) PCT Filed: May 27, 2004

(86) PCT No.: PCT/EP2004/005723

§ 371 (c)(1),
(2), (4) Date: May 25, 2006

(87) PCT Pub. No.: WO2005/000548

PCT Pub. Date: Jan. 6, 2005

(65) Prior Publication Data

US 2007/0040092 A1 Feb. 22, 2007

(30) Foreign Application Priority Data

Jun. 27, 2003 (DE) ..... 203 09 970 U

(51) Int. Cl.
*B28B 7/00* (2006.01)

(52) U.S. Cl. ..... 249/139; 249/2; 249/163; 249/187.1; 425/DIG. 33

(58) Field of Classification Search ..... 249/139, 249/163, 166, 169, 187.1, 219.1, 2; 425/3, 425/DIG. 33
See application file for complete search history.

(56) References Cited

U.S. PATENT DOCUMENTS 2,869,047 A * 1/1959 Smit et al. ..... 335/285
3,014,751 A * 12/1961 Smith ..... 294/65.5
3,319,989 A 5/1967 Ross
4,745,651 A * 5/1988 Schellenger ..... 7/158
4,804,320 A * 2/1989 Sommer et al. ..... 425/65
5,155,954 A * 10/1992 Roire ..... 52/125.5
5,277,396 A * 1/1994 Vappula ..... 249/65
5,975,483 A * 11/1999 Schule ..... 249/219.1
6,082,701 A 7/2000 Reymann
6,202,978 B1 3/2001 Vappula
6,276,657 B1 8/2001 Vappula
6,471,273 B1 * 10/2002 Friedrich et al. ..... 294/65.5
6,547,209 B1 * 4/2003 Vappula ..... 349/139

(Continued)

FOREIGN PATENT DOCUMENTS

DE 29 07 508 A1 9/1980

(Continued)

*Primary Examiner*—Philip C Tucker
*Assistant Examiner*—Dimple N Bodawala
(74) *Attorney, Agent, or Firm*—Flynn, Thiel, Boutell & Tanis, P.C.

(57) ABSTRACT

The invention relates to a holding device, preferably a shell device, which comprises a magnet that can be transferred from a locking position, in which the magnet is preferably operatively connected to a magnetizable shell support so as to magnetically act upon it, to a detach position in which the magnet is spaced apart from the shell support. The aim of the invention is to simplify a holding device of the above-described kind. The magnet, for the purpose of transferring it from the locking position to the detach position, is mounted so as to be rotatable about a swiveling axis in such a manner that in the detach position it is disposed so as to be swivelable via-à-vis the locking position.

26 Claims, 2 Drawing Sheets

U.S. PATENT DOCUMENTS

| | | | | |
|---|---|---|---|---|
| 6,742,759 | B2 * | 6/2004 | Vappula | 349/139 |
| 6,817,590 | B2 * | 11/2004 | Gargiulo | 249/205 |
| 7,021,601 | B2 * | 4/2006 | Vappula | 249/139 |
| 7,175,153 | B2 * | 2/2007 | Schreyer et al. | 249/139 |
| 2003/0189158 | A1 | 10/2003 | Vappula | |

FOREIGN PATENT DOCUMENTS

| | | | |
|---|---|---|---|
| DE | 93 00 658.6 | | 6/1993 |
| DE | 43 27 696 | A1 | 2/1995 |
| DE | 199 03 819 | A1 | 8/2000 |
| DE | 201 05 709 | U1 | 8/2001 |
| DE | 201 05 710 | U1 | 8/2001 |
| EP | 0 842 339 | B1 | 5/1998 |
| EP | 0 945 237 | A2 | 9/1999 |
| EP | 1 352 723 | A2 | 10/2003 |

* cited by examiner

HOLDING DEVICE

The present invention relates to a holding device, preferably a shuttering device, comprising a magnet that can be transferred from a locking position, in which the magnet is preferably operatively connected to a magnetizable shuttering support so as to magnetically act upon it, preferably by abutting to the shuttering support, to a detach position in which the magnet is spaced apart from the shuttering support.

Such a holding device is known, for example, from EP 0 842 339 B1. There, the holding device is formed by a shuttering device comprising a magnet. The magnet is arranged within the shuttering device and can be vertically lifted and lowered within this shuttering device. The shuttering device is placed upon a preferably metallic shuttering support, such as a shuttering table. In the locking position, the magnet rests on the shuttering support to prevent a shifting of the shuttering device along the surface of the shuttering support due to the magnetic force between magnet and shuttering support. For shifting the shuttering device on the shuttering support, the magnet has to be transferred to the detach position where it is spaced apart from the shuttering support. In this spaced position, the magnet no longer generates any magnetic holding force with respect to the shuttering support, so that the shuttering device can be shifted. For this purpose, two pins spaced apart and extending vertically opposite the shuttering support are provided by means of which the magnet can be lifted to be transferred from the locking position to the detach position. In the detach position, the magnet is arranged in parallel to its locking position, but spaced apart from the surface of the shuttering support. In its detach position, the magnet is held by springs between the pins and the shuttering device, at which the magnet is supported against its attraction force towards the shuttering support. The pins with the springs vertically project from the shuttering device and can be gripped by a lever. As they project from the shuttering device, they represent a risk of injury. Moreover, the pins and the springs can get very dirty, so that their function is not always ensured. The construction according to EP 0 842 339 is comparably complicated and expensive to be manufactured. As the magnet can be stepwise transferred from the locking position to the detach position by successively actuating two threaded bolts, the operation becomes more complicated.

Therefore, it is an object of the invention to provide a holding device which is as simple and reliable as possible and the operation of which is as simple as possible.

According to the invention, the object is achieved by a holding device of the type mentioned in the beginning, in which the magnet is mounted so as to be rotatable about a swivel pin for being transferred from the locking position to the detach position, so that in the detach position it is arranged in a swivelled manner with respect to the locking position.

This solution is simple and has the advantage that the magnet can be transferred from the locking position to the detach position spaced apart from the surface of the shuttering support by just one movement. This results in a very simple operability in which the magnet only has to be swivelled about its swivel pin to be transferred from the locking position to the detach position. Moreover, such a swivelling magnet can be easily manufactured. For doing so, the magnet should be arranged such that, in its locking position, it essentially flatly rests on the shuttering support to thus be as effective as possible. As it can be rotated about the swivel pin, it assumes a slightly inclined position with respect to the surface of the shuttering support immediately after the start of the transfer from the locking position to the detach position, so that the magnetic force rapidly decreases.

It can also be advantageous if the swivel pin is arranged at the side of the magnet. Thereby, it can be easily ensured that in the detach position the whole magnet maintains a sufficient distance with respect to the shuttering support.

Here, it can prove to be favourable to only provide one swivel pin for simplifying the construction.

To obtain a construction as simple as possible, the swivel pin can be formed by a swivel shaft mounted in the holding device. This in particular facilitates a retrofit of already existing holding devices as a swivel shaft can be easily retrofitted.

Here, it can be an advantage if the holding device is formed as a frame. Then, the holding device can e.g. be a support comprising the magnet and being suitable for various purposes of application.

It can moreover prove to be favourable if the holding device grips over the magnet at least by sections. Thereby, in a simple manner a stable construction having sufficient rigidity can be achieved.

In order to further simplify the operation of the holding device, the holding device can comprise a locking means which holds the magnet in its detach position.

In this case, the locking means can comprise a magnetizable or magnetic portion being operatively connected with the magnet so as to magnetically act upon it for holding the magnet in the detach position. Thereby, the magnet can be very easily locked in the detach position.

Furthermore, it can prove to be advantageous if the locking means is dimensioned such that the magnetic force between the locking means and the magnet is slightly larger than a restoring moment generated at least by the weight of the magnet and forcing the magnet into the locking position. This is to ensure that the holding force of the locking means is just large enough to lock the magnet in the detach position. The magnet is to be retransferred from the detach position to the locking position by a comparably low expenditure of force.

In order to obtain a construction as simple as possible, the upper surface of the magnet can be connectable with the locking means.

If in the detach position the major part of the magnet is arranged between swivel pin and locking means, the locking means only has to apply little force. This, too, permits a facilitation of operation.

In an advantageous development of the invention, an actuation means can be provided by means of which the magnet can be transferred from its locking position to its detach position.

In order to design the holding design with a surface as smooth as possible, an opening through which the magnet is accessible at least in its locking position can be provided.

A particular simple operation can be created if the actuation means comprises a lever which can be brought into engagement with the magnet for a transfer from the locking position to the detach position, or which is engaged with the magnet and is supported at the holding device so as to be swivelable.

In this case, it can be advantageous if the lever is mounted at the holding device to be rotatable about a lever swivel pin. This, too, permits a simplification of the construction and an increase of the operation convenience.

In order to further facilitate the operation, the magnet can be arranged between the lever swivel pin and the swivel pin. Thereby, the magnet is so to speak mounted to be rotatable on the one side, and on the other side, the lever acts upon the magnet to lift the magnet.

In an advantageous development of the invention, the holding device can be formed by a shuttering device. Then, the holding device can be integrally designed with a shuttering device. This permits the realization of a very compact construction.

Here, it can be advantageous if the shuttering device is essentially U-shaped, seen from the cross-section. This permits to achieve sufficient strength. Moreover, the U-shaped design permits the receipt of the magnet inside the shuttering device. The legs of the U-shaped cross-section of the shuttering device are supported in this case on the shuttering support and grip over the magnet.

In an advantageous development of the invention, the shuttering device can comprise the opening through which the lever projects inside and the lever can be operated outside the shuttering device for transferring the magnet from its locking position to the detach position.

Here, it can be advantageous if the opening is arranged at the upper surface of the shuttering device, as then it does not affect the functioning of the shuttering device.

Moreover, it can prove to be advantageous if the magnet at least by sections projects from the shuttering device in the detach position. Then it is easy to recognize that the magnet is in its detach position, and the operation for a retransfer to the locking position can be effected from outside.

Furthermore, it can prove to be advantageous if the magnet has a stop limiting the swivelling motion from the detach position to the locking position as soon as the magnet is slightly swivelled beyond the locking position. Such a stop can prevent the magnet from coming out of the shuttering device when the shuttering device is lifted from the shuttering support. In the locking position, the magnet should rest on the shuttering support to be essentially plane. If the shuttering device is lifted it suffices if the rotating motion of the magnet with respect to the locking position is stopped already after an angle of rotation of approx. 3° to 5°.

In order to facilitate a retrofit or replacement of the magnets, the swivel pin can be arranged in a bearing section which is releasably connected to the magnet.

In the following, the operation and function of the invention are illustrated more in detail.

Figure 1:
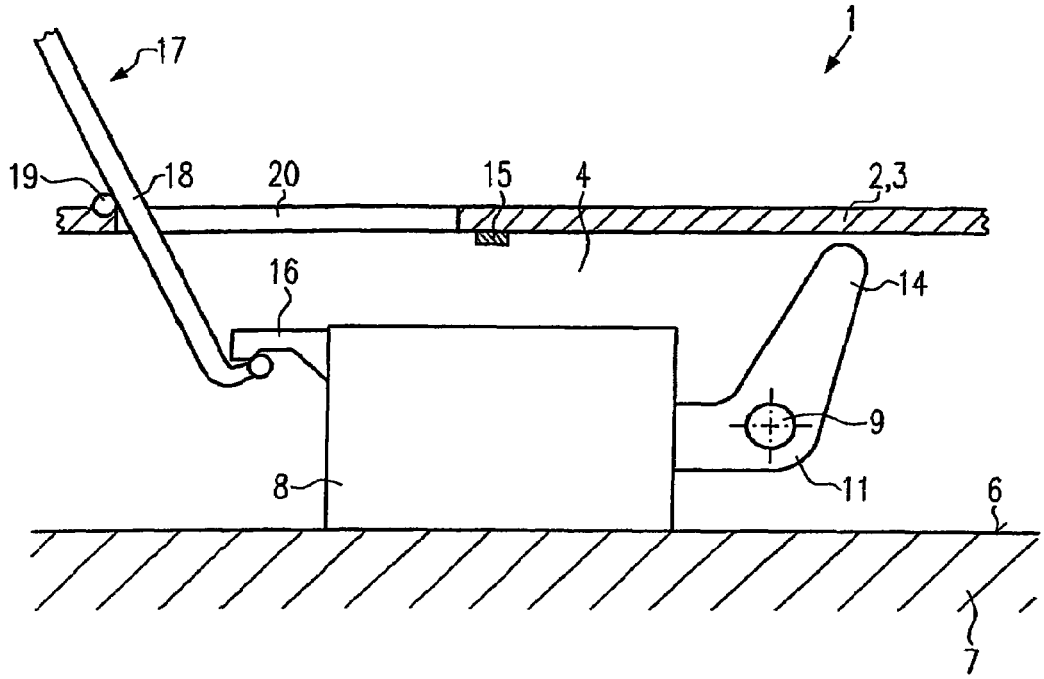
FIG. 1 shows the holding device according to the invention in a cross-sectional view with the magnet being in the locking position.
Figure 3:
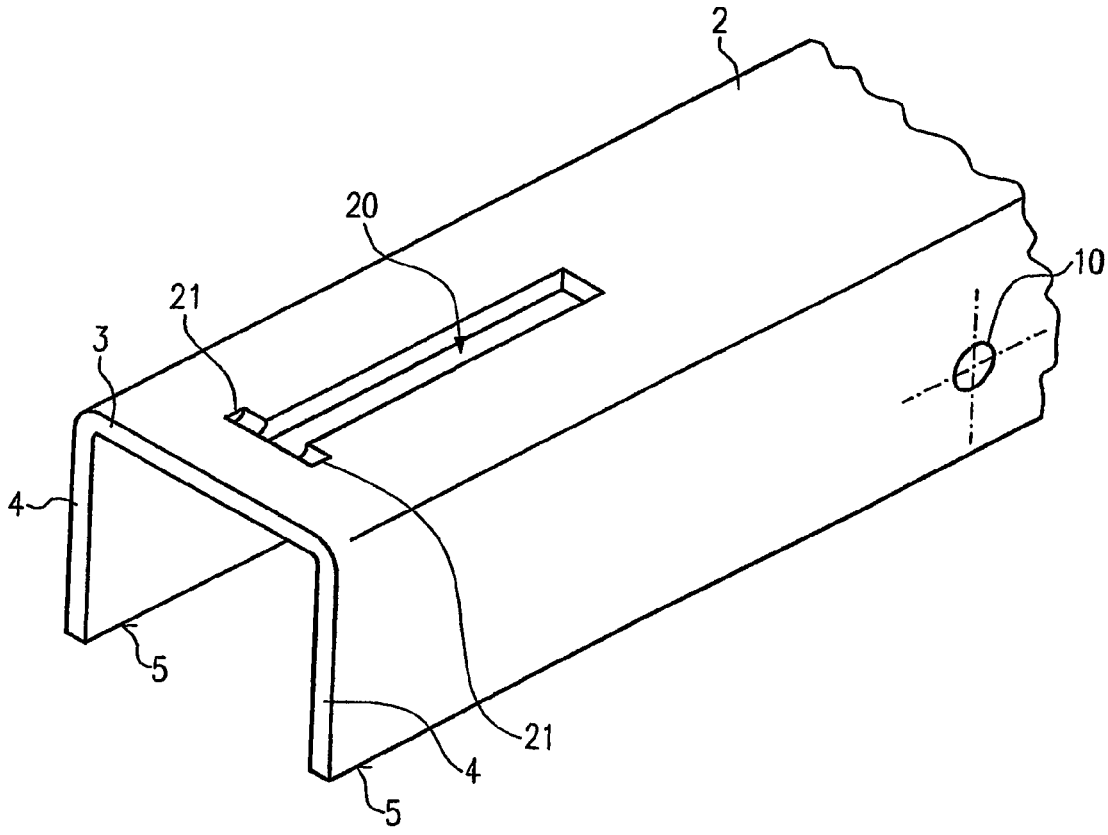
FIG. 3 shows a diagonal view of the holding device according to the invention.

FIG. 1 shows the holding device 1 in a cross-sectional view. The holding device comprises a shuttering device 2, which is preferably made of steel and has a U-shaped cross-section. This U-shaped cross-section can be easily seen in FIG. 3 and is formed by a cover wall 3 and legs 4 adjoining at both sides and extending in parallel. The shuttering device 2 rests on a surface 6 of a shuttering support 7 with supporting surfaces 5. The shuttering support 7 is preferably made of steel and is preferably part of a shuttering table.

Within the shuttering device, a magnet 8 is arranged which is mounted so as to be rotatable about a swivel pin 9. The swivel pin 9 is designed as swivel shaft and held in openings 10 of the shuttering device 2. It moreover extends through a bearing section 11 which is securely, however releasably, connected with the magnet 8 by means of threading. The swivel pin 9 is thus supported in the shuttering device 2 which thereby simultaneously forms a holding device for the magnet. The swivel pin 9 extends in parallel to the surface 6 of the shuttering support 7 and is spaced apart from the same. In the axial direction, the swivel pin 9 can be secured in a known manner by locking screws or the like. As an alternative, it is also conceivable to design the swivel pin 9 e.g. integrally with the shuttering device 2, or to design the magnet in the form of a swivelling journal which is again held in the bearing section 11 or the openings 10, respectively.

The magnet 8 is designed as permanent magnet in a known manner. In a locking position, as is shown in FIG. 1, the magnet rests with its bottom surface 12 flatly on the surface 6 of the shuttering support 7. Furthermore, the magnet comprises a support device 13 securely connected to the magnet and having a stop 14. The stop can be engaged with the cover wall 3 of the shuttering device 2. In the representation according to FIG. 1, the stop 14, however, is not engaged with the cover wall. Such an engagement is only effected if the magnet projects with respect to the supporting surfaces 5 of the shuttering device 2. Here, an angle of rotation of approx. 3° to 5° with respect to the position represented in FIG. 1 is sufficient. The stop 14 is then engaged with the cover wall 3 or is supported at the same, respectively.

Furthermore, a locking means 15 is provided. In the simplest case, the magnet rests at the cover wall 3 in its detach position if the shuttering device 2 is made of steel. In the present case, the locking means 15 is formed by a small steel plate at which the magnet abuts in the detach position. The size of the locking means 15 is here selected such that the arising magnetic force is slightly larger than the moment counteracting to the force between magnet and locking means and generated about the swivel pin 9 by the weight of the magnet together with the components connected thereto. This ensures, on the one hand, that the magnet remains in its detach position, on the other hand, it can also be retransferred from the detach position to the locking position with relatively little expenditure of force.

Furthermore, the magnet comprises an engagement section 16 which is securely connected to the magnet. The engagement section 16 is located on the side of the magnet opposed to the swivel pin. With an actuation means 17 comprising a lever 18 and a lever swivel pin 19, the magnet can be retransferred from its locking position to its detach position. In this case, the lever 19 extends through an opening 20 in the cover wall 3 forming the upper surface of the shuttering device 2. The lever swivel pin 19 can be formed either by an own axis or by an edge of the opening 20. It is important that the lever swivel pin 19 permits a swivelling of the lever. Furthermore, the lever can be removed to thus ensure a smooth outer surface of the shuttering device in the locking position. The lever swivel pin 19 is rotatably mounted in indentations 21.

Below, the operation and function of the invention are explained more in detail.

Figure 2:
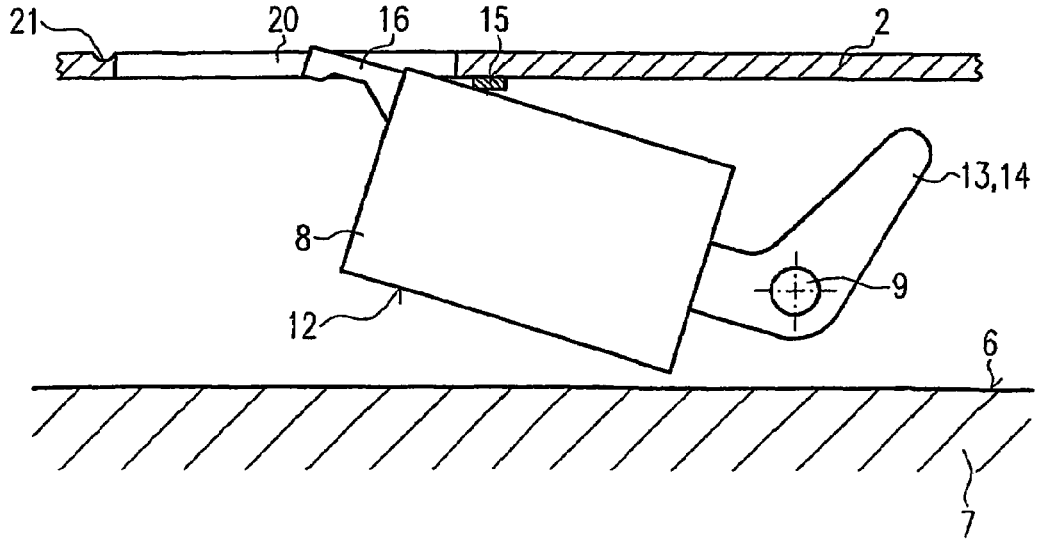
FIG. 2 shows the holding device according to the invention with the magnet being in the detach position.

The holding devices according to the invention are used for the manufacture of structural precast concrete parts. For this purpose, the holding devices are placed upon the surface 6 of the shuttering support 7. In the process, the shuttering device 2 of the holding device 1 rests with the supporting surfaces 5 on the surface 6. This can be easily seen in FIGS. 1 and 2. In the detach position as represented in FIG. 2, the magnet is in a swivelled position, such that its bottom surface 12 is inclined by approx. 15° to 30° with respect to the surface 6. With its upper surface, it abuts the locking means 15. By the magnetic force, it is secured to the locking means 15. The shuttering device 2 or holding device 1, respectively, is now shifted to the corresponding position. As soon as the desired position is achieved, the magnet 8 is pushed downwards through the opening 20. Thereby, it is spaced apart from the locking means 15 and falls down to the upper surface 6 of the shuttering support 7 by its own weight. In the process, it is rotated about its swivel pin 9 which is spaced apart from the surface 6 and arranged in such a manner that it rests with its whole bottom surface 12 on the surface 6 of the shuttering support 7 in the locking position as it is represented in FIG. 1. In this position, the magnet generates the maximum magnetic holding force with respect to the surface 6 of the shuttering support 7. As the magnet 8 is securely connected in directions in parallel to the surface 6 of the shuttering support 7 via the swivel pin, the shuttering device 2 cannot be shifted with respect to the shuttering support 7.

After the manufacture of the precast concrete parts, the holding device or shuttering device 2, respectively, can be again removed from the shuttering support 7 or shifted thereon. To this end, the magnet 8 has to be transferred from its locking position to the detach position. For this, the lever 18 is introduced into the opening 20 so that it grips behind the engagement section 16. The lever 18 is supported at the lever swivel pin 19 so that the magnet is lifted and transferred to the detach position by a pressure on the lever 18. The lifting is performed until the magnet is swivelled to such an extent that it abuts the locking means 15. The lever 18 can then be removed again.

In the detach position, the magnet or the engagement means of the magnet protrudes through the opening 20 and projects with respect to the cover wall 3. This permits to optically recognize that the magnet is in its detach position. By pressure on the engagement means, the magnet can be again transferred to its locking position. This makes the magnet also suited for an industrial manufacture with robots. The robot only has to drive over the surface of the shuttering device to transfer the magnet from the detach position to the locking position in the process.

If the shuttering device 2 is now lifted from the shuttering support 7, it can happen that the magnet is unintentionally detached from the locking means 15. The stop 14 is provided in order to avoid that the magnet 8 rotates to completely leave the shuttering device 2. The stop 14 comes into engagement with the cover wall as soon as the magnet slightly projects with respect to the supporting surfaces. It is thus possible to place the magnet onto the shuttering support in this position, too. It is then again slightly pushed inwards by the shuttering support, so that it assumes the locking position. The stop 14 is then spaced apart from the cover wall 3.

The solution according to the invention provides a robust and reliable holding device or shuttering device, respectively, which is easy to manufacture and to operate. In the present embodiment, the holding device is integrated in a shuttering device. However, it is also conceivable to provide a support that forms the holding device and can be e.g. subsequently incorporated into a shuttering device 2. Such a holding device can also be employed otherwise. Due to the simplicity of construction, it is moreover possible to retrofit known shuttering devices. It is only necessary to provide openings 10 for the swivel pin 9 and to additionally provide an opening 20.

The invention claimed is:

1. Holding device, comprising a magnet that can be transferred from a locking position, in which the magnet is operatively connected to a magnetizable shuttering support so as to magnetically act upon it by abutting the shuttering support, to a detach position in which the magnet is spaced apart from the shuttering support, wherein the magnet is mounted so as to be rotatable about a swivel pin to be transferred from the locking position to the detach position, such that it is arranged in a swivelled manner in the detach position with respect to the locking position, wherein the holding device is formed by a shuttering device comprising an opening through which a lever protrudes inwardly, the lever being operable from outside the shuttering device for transferring the magnet from its locking position to its detach position, and wherein in the detach position, the magnet protrudes from the opening of the shuttering device at least by sections.

2. Holding device according to claim 1, wherein the swivel pin is arranged at a side of the magnet.

3. Holding device according to claim 1, wherein only one swivel pin is provided.

4. Holding device according to claim 1, wherein the swivel pin is formed by a swivel shaft mounted at the holding device.

5. Holding device according to claim 1, wherein the holding device is designed as a frame.

6. Holding device according to claim 1, wherein the holding device grips over the magnet at least by sections.

7. Holding device according to claim 1, wherein the holding device comprises a locking means that holds the magnet in its detach position.

8. Holding device according to claim 7, wherein the locking means comprises a magnetizable or magnetic section that is operatively connected to the magnet so as to magnetically act upon it for holding the magnet in the detach position.

9. Holding device according to claim 7, wherein the locking means is dimensioned such that a magnetic force between the locking means and the magnet is slightly larger than a restoring moment generated at least by a weight of the magnet and forcing the magnet into the locking position.

10. Holding device according to claim 7, wherein an upper surface of the magnet can be brought into an operative connection with the locking means.

11. Holding device according to claim 7, wherein in the detach position a major part of the magnet is arranged between the swivel pin and the locking means.

12. Holding device according to claim 1, wherein an actuation means is provided with which the magnet can be transferred from its locking position into its detach position.

13. Holding device according to claim 7, wherein the holding device comprises an opening through which the magnet is accessible at least in its locking position.

14. Holding device according to claim 12, wherein the actuation means comprises a lever that can be engaged with the magnet for the transfer from the locking position to the detach position, or that is engaged with the magnet and is supported at the holding device so as to be rotatable.

15. Holding device according to claim 14, wherein the lever is mounted at the holding device so as to be rotatable about a lever swivel pin.

16. Holding device according to one claim 15, wherein the magnet is arranged between the lever swivel pin and the swivel pin.

17. Holding device according to claim 15, wherein the lever swivel pin is held at the holding device.

18. Holding device according to claim 1, wherein the shuttering device is essentially U-shaped, as seen from the cross-section.

19. Holding device according to claim 1, wherein the magnet is arranged within the shuttering device.

20. Holding device according to claim 1, wherein the opening is arranged at an upper surface of the shuttering device.

21. Holding device according to claim 14, wherein the lever can be removed at least in the locking position of the magnet.

22. Holding device according to claim 15, wherein the swivel pin is arranged in a bearing section which is releasably connected with the magnet.

23. Holding device according to claim 1, wherein the magnet has a stop limiting a swivelling motion from the detach position to the locking position as soon as the magnet is slightly rotated beyond its locking position.

24. Holding device, comprising a magnet that can be transferred from a locking position, in which the magnet is operatively connected to a magnetizable shuttering support so as to magnetically act upon it by abutting the shuttering support, to a detach position in which the magnet is spaced apart from the shuttering support, the magnet being mounted so as to be rotatable about a swivel pin to be transferred from the locking position to the detach position such that it is arranged in a swivelled manner in the detach position with respect to the locking position, a locking means holding the magnet in the detach position, wherein the locking means comprises a magnetizable or magnetic section that is operatively connected to the magnet so as to magnetically act upon it for holding the magnet in the detach position.

25. Holding device, comprising a magnet that can be transferred from a locking position, in which the magnet is operatively connected to a magnetizable shuttering support so as to magnetically act upon it by abutting the shuttering support, to a detach position in which the magnet is spaced apart from the shuttering support, the magnet being mounted so as to be rotatable about a swivel pin to be transferred from the locking position to the detach position such that it is arranged in a swivelled manner in the detach position with respect to the locking position, a locking means holding the magnet in the detach position, wherein the locking means is dimensioned such that a magnetic force between the locking means and the magnet is slightly larger than a restoring moment generated at least by a weight of the magnet and forcing the magnet into the locking position.

26. Holding device, comprising a magnet that can be transferred from a locking position, in which the magnet is operatively connected to a magnetizable shuttering support so as to magnetically act upon it by abutting the shuttering support to a detach position in which the magnet is spaced apart from the shuttering support, the magnet being mounted so as to be rotatable about a swivel pin to be transferred from the locking position to the detach position, such that it is arranged in a swivelled manner in the detach position with respect to the locking position, a locking means holding the magnet in the detach position, wherein in the detach position a major part of the magnet is arranged between the swivel pin and the locking means.

* * * * *